US007199888B2

(12) United States Patent
Parker et al.

(10) Patent No.: US 7,199,888 B2
(45) Date of Patent: Apr. 3, 2007

(54) METHOD FOR ENHANCED BLACK IN DRAFT MODE

(75) Inventors: Mark R. Parker, Portland, OR (US); Meng Yao, West Linn, OR (US); Stephen M. Kroon, Sherwood, OR (US)

(73) Assignee: Xerox Corporation, Stamford, CT (US)

( * ) Notice: Subject to any disclaimer, the term of this patent is extended or adjusted under 35 U.S.C. 154(b) by 902 days.

(21) Appl. No.: 09/892,027

(22) Filed: Jun. 25, 2001

(65) Prior Publication Data

US 2002/0196453 A1 Dec. 26, 2002

(51) Int. Cl.
*B41J 2/04* (2006.01)

(52) U.S. Cl. ..... 358/1.14; 358/1.8; 358/1.9; 382/258; 106/31.68; 106/31.9; 347/6; 347/7; 347/15; 347/21; 347/43

(58) Field of Classification Search ..... 358/1.4, 358/1.9, 1.8; 347/15, 16, 43, 6, 7, 21; 106/31.68, 106/31.9; 382/258
See application file for complete search history.

(56) References Cited

U.S. PATENT DOCUMENTS 5,428,377 A 6/1995 Stoffel et al. ..... 347/15
5,751,434 A 5/1998 Narendranath et al. ..... 358/298
5,867,635 A 2/1999 Siegel ..... 395/104
6,102,520 A * 8/2000 Terasawa ..... 347/43
6,166,824 A * 12/2000 Kadota ..... 358/1.15
6,312,102 B1 * 11/2001 Moriyama et al. ..... 347/43
6,466,332 B1 * 10/2002 Fukasawa ..... 358/1.9

* cited by examiner

*Primary Examiner*—Kimberly Williams
*Assistant Examiner*—Peter K. Huntsinger
(74) *Attorney, Agent, or Firm*—Jeannette Walder

(57) ABSTRACT

A method of improving black print quality in a color printer having at least one color ink and black ink includes determining a location on a substrate where a black pixel is to be printed, printing a droplet of color ink at the location, and printing a droplet of black ink with the color droplet. If the color printer includes cyan, magenta and yellow, then a droplet of cyan ink, magenta ink or yellow ink may be printed with the droplet of black ink. For images containing black at a plurality of locations, the cyan, magenta and yellow droplets may be equally distributed among the plurality of locations. Alternatively, the cyan, magenta and yellow droplets may be distributed in accordance with a digital halftone screen.

8 Claims, No Drawings

METHOD FOR ENHANCED BLACK IN DRAFT MODE

FIELD OF THE INVENTION

This invention relates generally to methods for enhancing print quality while maintaining print speed, and more particularly, to a method that enhances black in draft mode in color printing systems.

BACKGROUND OF THE INVENTION

Printing with multiple colors or multiple shades of gray uses a halftoning process to convert continuous tone images to a printable format. For instance, 24 bit/pixel continuous tone image data may be converted into 3 or 4 bit/pixel print data. This allows the use of printing technology that imprints ink in fixed quanta (i.e. zero or more droplets per pixel.) With only a few actual colors being printable, the perception of a multitude of color tones is created by the combination of adjacent printed pixels.

Solid ink jet printers employ phase-change inks that are solid at ambient temperatures and liquid at elevated operating temperatures. These printers eject liquid phase ink droplets from the print head at a higher than ambient operating temperature. The droplets solidify quickly upon contact with the surface of the receiving substrate to form a predetermined pattern. For a direct to media printer, the substrate is the media. For an offset printer, the substrate may be an accumulator drum, blanket, transfer belt or other intermediate carrier from which the ink is subsequently transferred to paper or other print media in a fusing or transfix process. Among the advantages of solid ink is that it remains in a solid phase at room temperature during shipping and long-term storage. Problems with clogging in the print head are less prevalent than occur with aqueous based ink jet print heads. The rapid solidification or hardening of the ink drops upon striking the receiving substrates permits high quality images to be printed on a wide variety of printing media.

Solid ink printers may be designed to use any number of inks, but typically use four ink colors: cyan (C), magenta (M), yellow (Y) and black (K). Color images are formed on the receiving substrate by placing combinations of zero or more droplets of C, M, Y, or K ink at each pixel location. For example, if a green pixel is required, one drop of yellow ink is deposited with one drop of cyan. In most four color printers using CMYK colors, combinations of equal parts CMY or CMY plus any K droplets, placed together on one or distributed over a neighborhood of pixel locations, is perceived as approximately a neutral color where neutral is defined as perceptually near gray. This provides at least two ways to produce any approximately gray color when using a typical four-color ink set.

In a solid ink printer, output speed and printer resolution are determined by factors including droplet size, droplet spacing and number of droplets formed in the same location. Many printers support multiple user selectable output modes providing a range of output quality and print speed tradeoffs. For example, in draft or fast color mode, pages per minute are increased, usually at the expense of print quality. While draft mode may be achieved by changing the size of the droplets, increasing the spacing between droplets, decreasing the number of droplets or some combination thereof, in most ink jet printers draft mode is accomplished by increasing the droplet spacing to reduce the number of rows and/or columns that must be marked thereby increasing print speed.

Increased droplet spacing reduces addressability and, without a corresponding increase in droplet size, decreases density. With decreased density, draft mode black may not be dense enough causing such print quality problems as poor black text and mottled look on black fills.

SUMMARY OF THE INVENTION

A method of enhancing black in draft mode while maintaining print speed, according to the invention, includes depositing droplets of color ink with droplets of black ink at pixel locations where only black was requested. This enhances the black density. The method of improving black print quality may be used with any printer that places ink in discrete quanta (i.e., liquid inkjet or solid inkjet or toner). However, the method of the invention will be described, for convenience, with reference to a solid ink printer.

A method for improving black print quality in a color printer having at least one color ink and black ink, according to the invention, includes determining a location on a substrate where a black pixel is to be printed, printing a droplet of color ink at the location and printing a droplet of black ink with the droplet of color ink. For images containing black at a plurality of locations, the cyan, magenta and yellow droplets may be equally distributed among the plurality of locations. In one embodiment, the color droplet is placed on the media so that the black droplets lie over them on the printed page. Not all of the black locations need be under printed with a color droplet. For example, it may be desired to enhance only text in a particular image. Thus only black text locations may be selected for enhancement. In other applications, it may be desired to enhance black fills. So, only black fills may be selected for enhancement.

To maximize black density, as many color droplets as possible may be printed with each black droplet. However, in a solid ink printer, it is generally preferred to use no more than two layers of ink. In a solid ink printer with this limitation, one color droplet will be placed with a black droplet (note that a droplet becomes a dot when it solidifies). The ratio of cyan droplets, magenta droplets and yellow droplets printed with the black droplets may be determined by gray balancing. With balanced cyan, magenta, and yellow (i.e., equal amounts producing a neutral gray), one third of the black dots can each be printed with a cyan dot, another one third of the black dots can each be printed with a magenta dot and the remaining one third of the black dots can each be printed with a yellow dot. This way, each black pixel is printed with a black and a color dot of cyan, magenta or yellow. This kind of coverage will not result in print quality problems.

However, in some instances, when black is printed with equal amounts of cyan, magenta and yellow, a color tint may be noticeable in the black. The ratios of cyan, magenta and yellow can be adjusted to make the black neutral (the ratio of cyan droplets, magenta droplets and yellow droplets printed with the black is determined so as to minimize chromaticity in the black.). For example, instead of using one-third each of cyan, magenta and yellow, 31% cyan+38% magenta+31% yellow can be used to balance the black. Other distributions of the three colors may also be used. In a solid ink printer, it is generally desirable for maximum enhancement of black that the total amount of cyan plus magenta plus yellow equals 100% of the desired black ink coverage. There may be other cases where more or less than 100% of the desired black is optimal. It may be noted that many modified versions of enhanced black may also be employed. For example, it may be important to enhance black text and lines, while leaving black fills unenhanced. Thus, a color dot is printed with each black dot of the black text or line, but not the black fill. This method of the invention also smoothes some of the coarseness and ragged edges caused by using a low-resolution print mode. In other cases, it may be important to leave black text and lines unenhanced, while increasing the density of black fills. One other example would be when it may be important to vary the kind or amount of black enhancement depending on image features such as edges, interiors, etc. and add different amounts of color drops to the black drops in different locations.

There are many ways to decide which black dots are printed with cyan, which black dots are printed with magenta and which black dots are printed with yellow. One implementation is to make three mutually exclusive 33.3% patterns to be used for cyan, magenta and yellow. In one embodiment, a stochastic pattern is used. For each black dot, if the bit in the corresponding location in the cyan pattern is on, the black dot is printed with a cyan dot. Similarly, if the bit in the corresponding location in the magenta pattern is on, the black dot is printed with a magenta dot and if the bit in the corresponding location in the yellow pattern is on, the black dot is printed with a yellow dot. Since the three patterns are mutually exclusive, meaning they do not have dots turned on at the same location, black will always be printed with one color dot.

Instead of using three mutually exclusive bit patterns, a single halftone screen can be used. The upper ⅓ thresholds in the halftone screen can be used to indicate that cyan should be printed with black at those locations; the middle ⅓ thresholds in the halftone screen can be used to indicate that magenta should be printed with black at those locations, and the lower ⅓ thresholds in the halftone screen can be used to indicate that yellow should be printed with black at those locations. This is effectively the same as using three mutually exclusive bitmap patterns. In another embodiment, a stochastic halftone screen may be used.

The method of the invention may also be used with the halftone screens described in co-assigned, co-pending U.S. patent application Ser. No. 09/198,024, filed Nov. 23, 1998, to Yao et al., entitled "Color Printer Halftoning Method," the disclosure of which is incorporated herein by reference.

The method of the invention can be used in combination with non-aligned halftone screens. A method for generating non-aligned screens is described in co-assigned, co-pending U.S. patent application Ser. No. 09/222,038 filed Dec. 29, 1998, entitled "Color Printer Halftoning Method and Apparatus", which is incorporated herein by reference. Each halftone screen corresponds to one of the ink (or display output) colors from the set of three colors. For illustration purposes, assume that the input color is a CMY color, and the printer is a CMYK printer. For example, the following equations may be used to generate CMYK to be halftoned by non-aligned screens:

$$K=\mathrm{MIN}(C,M,Y)$$

$$C=C-K$$

$$M=M-K$$

$$Y=Y-K$$

$$C=C+(C_\mathrm{PER}*K)$$

$$M=M+(M_\mathrm{PER}*K)$$

$$Y=Y+(Y_\mathrm{PER}*K)$$

where MIN(C,M,Y) is the minimum of C, M and Y, and C_PER is the percentage of black to be printed with cyan dots, M_PER is the percentage of black to be printed with magenta dots and Y_PER is the percentage of black to be printed with yellow dots. The first four lines actually replace the gray component in the CMY color with black.

Assume for example maximum ink under coverage, i.e., 100% CMY. After applying the above equations, the output CMYK values are C=C_PER, M=M_PER, Y=Y_PER and K=100%. Since CMY uses non-aligned screens, and C_PER+M_PER+Y_PER=100%, each black dot will be printed with either a cyan, magenta or yellow dot. A benefit of this halftone screen implementation is that the CMYK values can be halftoned directly to achieve under color black and no other processing is necessary. This implementation ensures that for 100% black, each black dot is aligned with a color dot in the specified ratios.

When the color is not 100% black, some black dots may not be printed with a color dot and the ratios of CMY dots printed with black dots may not be the ratios of C_PER, M_PER and Y_PER. This may not be a problem, because, for example, it is not necessary for each black dot to have a color dot with it in dithered black, and any hue changes in grays as a result of the ratios of CMY dots printed with black can be corrected by a lookup table. Also, as discussed earlier, some implementations may select to treat some black regions differently than other black regions.

The method of the invention may be implemented in: application software such as image processing and editing software, operating systems having image processing capabilities, printer or display driver software (e.g., an optional printer driver selection to enhance black draft mode in a selected printer), video image processing software, media storing any such software, hardware such as memory storage chips in printers, computers, monitors, or other image display or generation devices, or any other device or source for image generation.

The invention has been described with reference to a particular embodiment. Modifications and alterations will occur to others upon reading and understanding this specification taken together with the drawings. The embodiments are but examples, and various alternatives, modifications, variations or improvements may be made by those skilled in the art from this teaching which are intended to be encompassed by the following claims.

What is claimed is:

1. A method for improving black pixel print quality in an ink color printer having at least one color ink and black ink, comprising:

selecting a fast print mode, wherein fast print mode is accomplished by increasing droplet spacing to reduce the number of rows and columns that must be marked thereby increasing print speed and printing no more than two droplets at a single location;

determining a location on a substrate where a black pixel is to be printed;

printing a single droplet of color ink at the location, printing a single droplet of black ink on top of the color droplet at the same location, wherein the droplet of color ink and the droplet of black ink are of substantially the same size, forming a single black pixel having increased density of substantially the same size as each of the black arid color droplets at the location when the two droplets solidify;

wherein the color printer includes cyan, magenta and yellow and wherein the step of printing a droplet of color ink comprises printing a droplet of one of cyan ink, magenta ink and yellow ink;

determining a plurality of locations on a substrate where a black pixel is to be printed;

printing a droplet of color ink at each of the locations, wherein cyan, magenta and yellow droplets are equally distributed among the plurality of locations; and printing a droplet of black ink on top of each droplet of color ink at each black pixel location, wherein the droplet of color ink and the droplet of black ink are of substantially the same size.

2. A method for improving black print quality in an ink color printer having at least one color ink and black ink, comprising:

selecting a fast print mode, wherein draft mode is accomplished by increasing droplet spacing to reduce the number of rows and columns that must be marked thereby increasing print speed and printing no more than two droplets at a single location;

providing an image to be printed on a substrate;

determining locations within the image where black pixels are to be printed;

for each location where a block pixel is to be printed:

printing a single droplet of color ink at the location, and printing a single droplet of black ink on top of the color droplet at the same location, wherein the droplet of color ink and the droplet of black ink are of substantially the same size, forming a single black pixel having increased density of substantially the same size as each of the black and color droplets at the location when the two droplets solidify;

wherein the color printer includes cyan, magenta and yellow and wherein the step of printing a single droplet of color ink comprises printing a single droplet of one of cyan ink, magenta ink and yellow ink at each of the black locations;

wherein the cyan, magenta and yellow droplets are equally distributed among the black locations.

3. The method of claim 2, further comprising:

using three mutually exclusive 33.3% bit patterns, one for each of cyan, magenta and yellow, to select which of cyan, magenta and yellow to print at each of the black locations.

4. The method of claim 2, further comprising:

using a stochastic halftone screen to select which of cyan, magenta and yellow to print at each of the black locations, wherein the upper ⅓ thresholds are used to select cyan, the middle ⅓ thresholds are used to select magenta and the lowest ⅓ thresholds are used to select yellow.

5. The method of claim 2, further comprising:

using three non-aligned halftone screens to select which of cyan, magenta and yellow to print at each of the black locations, using $$K=\mathrm{MIN}(C,M,Y)$$

$$C=C-K$$

$$M=M-K$$

$$Y=Y-K$$

$$C=C+(C_\mathrm{PER}*K)$$

$$M=M+(M_\mathrm{PER}*K)$$

$$Y=Y+(Y_\mathrm{PER}*K)$$

to generate CMYK to be halftoned by non-aligned screens, wherein MIN(C,M,Y) is the minimum of C, M and Y, C_PER is the percentage of black to be printed with cyan droplets, M_PER is the percentage of black to be printed with magenta droplets, Y_PER is the percentage of black to be printed with yellow droplets.

6. The method of claim 2, further comprising determining the ratio of cyan droplets, magenta droplets and yellow droplets printed with the black droplets by gray balancing.

7. The method of claim 2, further comprising adjusting the ratio of cyan droplets, magenta droplets and yellow droplets printed with the black so as to minimize chromaticity in the black.

8. The method of claim 7, wherein the ratio of cyan droplets is approximately 31%, the ratio of magenta droplets is approximately 38% and the ratio of yellow droplets is approximately 31%.

* * * * *